United States Patent [19]

McGill

[11] 4,408,485

[45] Oct. 11, 1983

[54] ROTARY STRADDLE TESTER APPARATUS WITH SAFETY JOINT BACK-OFF CLUTCH

[75] Inventor: Howard L. McGill, Lufkin, Tex.

[73] Assignee: Schlumberger Technology Corporation, New York, N.Y.

[21] Appl. No.: 276,042

[22] Filed: Jun. 22, 1981

[51] Int. Cl.[3] ..... E21B 47/00

[52] U.S. Cl. ..... 73/155; 166/237

[58] Field of Search ..... 166/106, 122, 131, 142, 166/184, 188, 237; 73/155

[56] References Cited

U.S. PATENT DOCUMENTS 3,308,887 3/1967 Nutter ..... 166/150

3,926,254 12/1975 Evans et al. ..... 166/106

OTHER PUBLICATIONS p. 636, 1974–1975 edition, "Composite Catalog of Oilfield Equipment and Services".

*Primary Examiner*—Jerry W. Myracle

[57] ABSTRACT

In accordance with an illustrative embodiment of the present invention, a one-way clutch mechanism is incorporated between the mandrel and housing of a rotary-operated pump apparatus that is used to inflate the packers of a drill stem testing system. The mandrel can be freely rotated to the right to operate the pump, however left-hand rotation causes the clutch mechanism to engage and the housing to be rotated with the mandrel to the left to disconnect a safety joint located in the tool string between the pump apparatus and the packers.

8 Claims, 4 Drawing Figures

ROTARY STRADDLE TESTER APPARATUS WITH SAFETY JOINT BACK-OFF CLUTCH

FIELD OF THE INVENTION

This invention relates generally to inflatable packer drill stem testing systems, and particularly to a new and improved rotary pump apparatus which includes a clutch to enable backing off a safety joint located between the pump and the packers in the event the packers for any reason become stuck in the well.

BACKGROUND OF THE INVENTION

Where inflatable packers are used to isolate a well interval to be tested, it is fairly common practice to use a downhole pump that is operated in response to rotation of the pipe string on which the test tools are suspended. The housing of the pump is coupled to drag springs or the like which engage the well bore wall to prevent rotation of the housing, and a mandrel assembly that extends into the housing is rotated relative thereto to cause pump piston reciprocation via a rotary-to-reciprocating motion converter.

There is always the risk in drill stem testing that the packer elements can become stuck in the well for a variety of reasons. For example, a damaged rubber element may wedge the tool in the hole, or differential pressure sticking can occur. Should this happen, it is desirable to be able to remove as much of the downhole tool string as possible before the stuck tools are washed over. For this purpose, it is fairly typical practice to include a safety joint located just above the upper packer element which can be backed off in response to manipulation of the pipe so as to intentionally part the tool string at that point. Since the mandrel and housing assembly of a rotary pump must necessarily provide a freely rotatable joint, the operation of a safety joint located therebelow can be a problem for apparent reasons. It is to a unique solution to this problem that the present invention is directed.

A general object of the present invention is to provide a new and improved rotary operated downhole pump assembly of the type described where the mandrel can be freely rotated relative to the housing only in the hand direction (usually right) normally used to actuate the pump.

Another object of the present invention is to provide a new and improved rotary operated downhole pump assembly of the type described that includes a clutch mechanism which allows free right-hand rotation of the mandrel relative to the housing but which engages in response to left-hand rotation to force the housing to rotate with the mandrel and cause back-off at a safety joint included in the tool string therebelow.

SUMMARY OF THE INVENTION

These and other objects are attained in accordance with the concepts of the present invention through the provision of pump apparatus comprising a housing adapted to be held stationary in the well bore and having a mandrel extending therein and adapted to be rotated by the pipe string which extends upwardly to the surface. A clutch means mounted between the mandrel and the housing includes one or more spring-loaded keys which ride against a surrounding surface within the housing. The surface is formed to include ramps which lead to diametrically opposed, radially directed stop shoulders that face in the normal direction of rotation of the mandrel, typically right-hand or clockwise when viewed from above. Thus as the mandrel is rotated to the right, the keys merely pass the stop shoulders and are cammed back inwardly to their normal diameters by the ramps. On the other hand should the mandrel be rotated to the left, the keys will come against the stop shoulders to corotatively couple the mandrel and housing so that the housing can be rotated by the pipe string to the left to back off a safety joint located in the tool string therebelow.

BRIEF DESCRIPTION OF THE DRAWINGS

The present invention has other objects, features and advantages that will become more clearly apparent from the following description of a preferred embodiment, taken in conjunction with the appended drawings in which.

DESCRIPTION OF A PREFERRED EMBODIMENT

Figure 1:
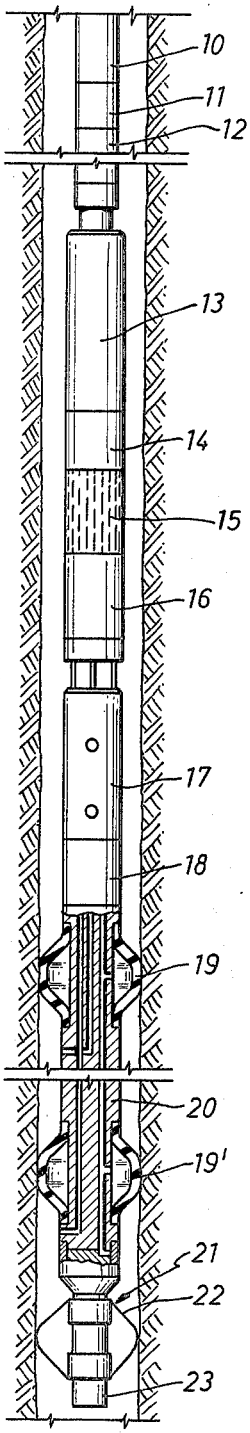
FIG. 1 is a schematic view of a string of drill stem testing tools, utilizing inflatable packers, suspended in a well bore.

As shown in FIG. 1, the string of drill stem testing tools that is suspended in the well bore on drill pipe or tubing 10 generally includes a reverse circulating valve 11 of any suitable design that is connected by a length of pipe 12 above a multiflow evaluator or test valve assembly 13 that can be alternatively opened and closed to correspondingly flow and shut in the well interval to be tested. A preferred form of test valve 13 is described in Nutter U.S. Pat. No. 3,308,887, assigned to the assignee of this invention. The lower end of the test valve 13 is connected to a recorder carrier 14 that houses a typical pressure recorder which functions to make a permanent record of fluid pressure versus elapsed time as the test proceeds. The recorder carrier 14 is connected to the upper end of a screen sub 15 through which well fluids are taken in during operation of a packer inflation pump assembly 16 connected to the lower end thereof. The pump assembly 16 is disclosed in considerable detail in Upchurch U.S. Pat. No. 4,320,800 issued Mar. 23, 1982, also assigned to the assignee of this invention. The disclosure of the Upchurch application is incorporated herein by reference.

The lower end of the pump assembly 16 is connected to a pressure equalizing and packer deflating valve assembly 17 that is disclosed and claimed in my U.S. Pat. No. 4,320,800.

A safety joint 18 of the general type shown, for example, at page 636 of the 1974–75 edition of the "Composite Catalog of Oilfield Equipment and Services" is connected between the lower end of the valve assembly 17 and the upper end of a straddle-type inflatable packer system which includes an upper packer element 19 and a lower packer element 19' that are connected together by an elongated spacer sub 20. The packer elements 19 and 19' each include an internally reinforced elastomeric sleeve that normally is retracted but which can be expanded outwardly by applied internal pressure into sealing contact with the surrounding well wall. The length of the spacer pipe 20 is selected such that during a test the upper packer 19 is above the upper end of the formation interval of interest while the lower packer 19' is below the lower end of the interval. Of course, when the elements 19 and 19' are expanded, the well bore region therebetween is isolated or sealed off from the rest of the well bore so that a fluid recovery from the interval can enter via test ports in the pipe 20 and be conducted upwardly through the tools described above and into the pipe string 10. A test port, packer inflation passages and a typical straddle bypass passage are shown schematically in the cross-hatched area of FIG. 1.

The lower end of the packer system is connected to the upper end of a deflate-drag spring tool 21 of the type disclosed in the above-mentioned Upchurch application. The drag springs 22 associated with the tool 21 are bowed outwardly and frictionally engage the walls of the well bore to hold the packer system and the housing of the pump assembly 16 against rotation to enable pipe string rotation to be used to operate the pump 16. Another recorder carrier 23 can be connected to the lower end of the drag spring tool 21 and arranged to house pressure recorders that provide comparative readings to those taken by the upper instrument 14.

Figure 2:
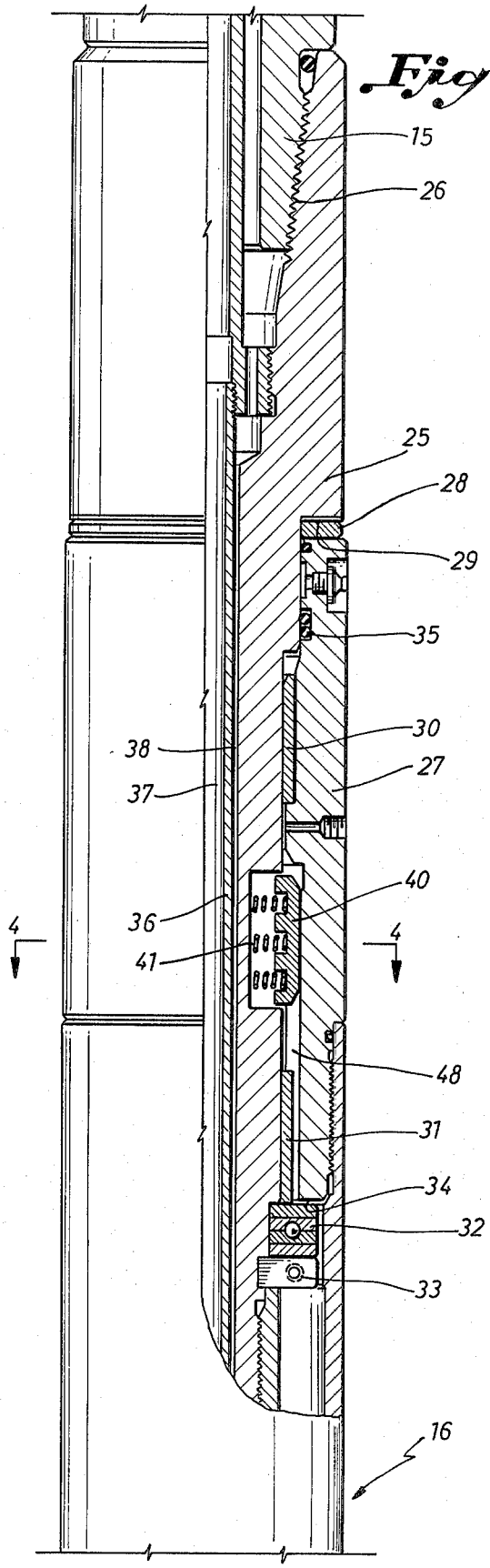
FIG. 2 is a longitudinal sectional view, with portions in side elevation, of the apparatus of the present invention.

Turning now to FIG. 2 for an illustration of the structural details of various component parts of the present invention, the mandrel 25 of the pump assembly 16 is connected by threads 26 to the lower end of the screen sub 15 and extends downwardly within the upper end portion of the housing 27 of the pump assembly 16. A thrust ring 28 that is positioned between the upper end of the housing 27 and a downwardly facing shoulder 29 on the mandrel 25, as well as upper and lower radial bearings 30 and 31, provide for smooth and stable rotation on the mandrel 25 with respect to the housing 27. A roller thrust bearing 32 located between a stop flange 33 on the mandrel 25 and a downwardly facing shoulder 34 on the housing section 27 retains the rotating joint in assembled relationship. A flow tube 36 that extends axially through the mandrel 25 provides a passage 37 for the flow of formation fluids, and the annular clearance space 38 between the tube and the inner wall of the mandrel 25 defines a part of the intake passage through which well fluids are brought in from the well annulus via the screen 15 and supplied to the intake check valves of the pump assembly 16. A seal 35 prevents fluid leakage into the joint.

The details of the pump assembly 16 are set forth in great detail in the Upchurch application referred to above and need not be set forth herein. Another similiar construction is disclosed in U.S. Pat. No. 3,926,254, issued Dec. 16, 1975, which also is incorporated herein by reference. Generally the pump 16 includes an annular piston that is driven up and down within a cylinder in response to rotation of the mandrel 25 relative to the housing 27. Rotary-to-reciprocating motion conversion is accomplished by cam rollers on the lower end of the mandrel 25 that engage in an undulating groove that extends circumferentially of the upper end of a piston drive sleeve which is splined to the housing 27. During each upward movement of the piston, well fluids are taken into the pump cylinder via one-way inlet check valves and on each downward movement the fluids are exhausted from the cylinder under pressure to the packer inflation passage via one-way outlet check valves. So long as the mandrel 25 is rotated to the right, the pump will continue to operate until a predetermined maximum inflation pressure is reached as disclosed in the above-mentioned Upchurch application. At that pressure a spring linkage in the piston drive train will begin to yield so that the piston stops reciprocating within the cylinder. Another pressure limiting arrangement in the form of a spring-loaded valve sleeve is shown in the U.S. Pat. No. 3,926,254 patent.

Figure 3:
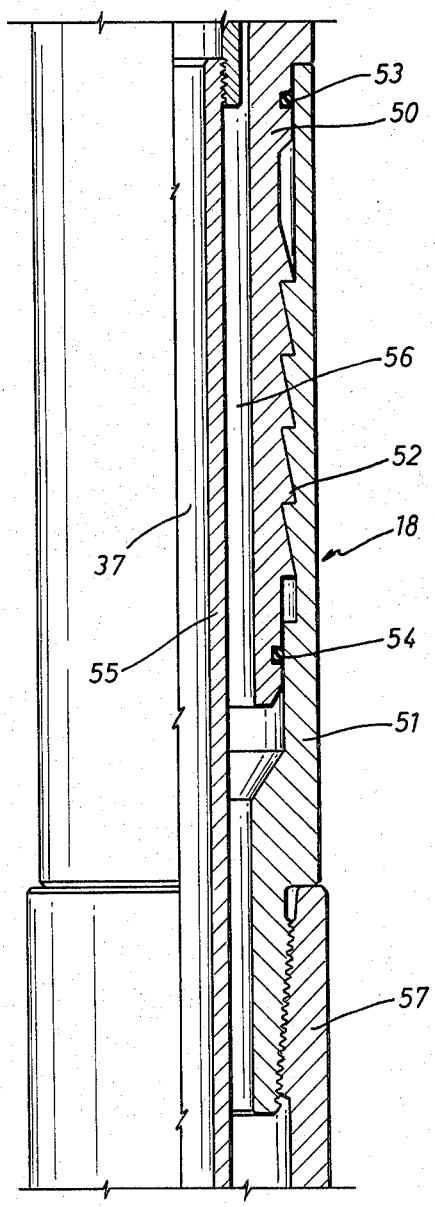
FIG. 3 is a view similar to FIG. 2 of a safety joint that is located in the tool string above the upper packer.

The safety joint 18 that is connected between the lower end of the packer deflate-equalizing valve 17 and the upper packer assembly 19 is shown in FIG. 3. The joint includes a pin section 50 that is threaded to a box section 51 by very coarse threads 52 that are formed on a right-hand helix. Upper and lower seals 53 and 54 prevent fluid leakage past the threads 52. A flow tube 55 that extends through the bore on the safety joint 18 provides continuations of the test passage 37 and an inflation passage 56 that leads from the pump outlet to the interior of the respective packing elements 19 and 19'.

The box section 51 of the safety joint 18 is threaded into the mandrel 57 of the upper packer assembly 19 and thus is rigidly fixed thereto. The pin section 50 is connected to the housing 27 of the pump assembly 16 via the mandrel and housing of the deflate-equalizing valve 17 that have a slidable spline coupling as shown schematically in FIG. 1. Thus it will be evident that so long as the pipe string 10 is rotated to the right with respect to the inflatable packer assemblies 19 and 19', there will be a tightening effect with respect to the safety joint 18.

Referring again to FIG. 2 it will be seen that diametrically opposed clutch keys 40 that are urged outwardly by coil springs 41 or the like are movably received in rectangular recesses 42 that are formed in the outer periphery of the mandrel 25. As shown in cross-section in FIG. 4, the outer face 43 of each key 40 rides during rotation against a surface 44 of the inner wall of the housing section 27. The surface 44 has ramp portions 45 that incline outwardly and which lead to the outer wall 46 of radially directed recesses each having a side wall that forms a stop shoulder 48 which faces in the clockwise direction of rotation.

OPERATION

In operation, the string of tools assembled end-to-end as shown in FIG. 1 is run into the well bore on the pipe 10. As the equipment is being lowered, the drag springs 22 frictionally engage the walls of the well bore to afford restraint to vertical as well as rotational movement. The pipe string 10 is either empty of well fluids, or may contain a short column of water to act as a cushion as will be apparent to those skilled in the art. In any event, the interior of the pipe string 10 provides a low pressure region which can be communicated with an isolated well interval to induce fluids to flow from the formation into the pipe string if they are capable of so doing.

When the tool string is located at the proper depth, the test interval is isolated by inflating the elements 19 and 19' into sealing contact with the well wall through operation of the pump assembly 16. This is accomplished by rotating the pipe 10 to the right to cause the pump to intake fluids from the annulus via the screen 15 and to supply the fluids under pressure to the respective interiors of the packer elements. During right-hand rotation, the keys 40 ride against the wall surface 44, and the ramps 45 cause the keys to shift back inwardly as they pass the shoulders 48 during each revolution.

When the packer elements 19 and 19' have been fully inflated, rotation of the pipe 10 is stopped. To initiate the test, the weight of the pipe 10 is slacked off on the packer elements to close the deflate-equalizing valve 17 and to open the test valve 13. The test valve 13 is left open for an initial flow period to draw down the pressure in the isolated well bore interval, and then the test valve is closed to shut-in the interval and obtain pressure build-up data. Of course, the test valve 13 can be opened and then closed repeatedly to obtain additional pressure data.

To terminate the test, the packer elements 19 and 19' are deflated by holding a stain on the pipe 10 for a time sufficient to overcome a hydraulic delay system included in the deflate-equalizing valve 17, whereupon pressure equalizing and deflate ports are opened to enable the elements to inherently retract. Then the tool string can be withdrawn from the well, or moved to another level in the well for additional tests.

Figure 4:
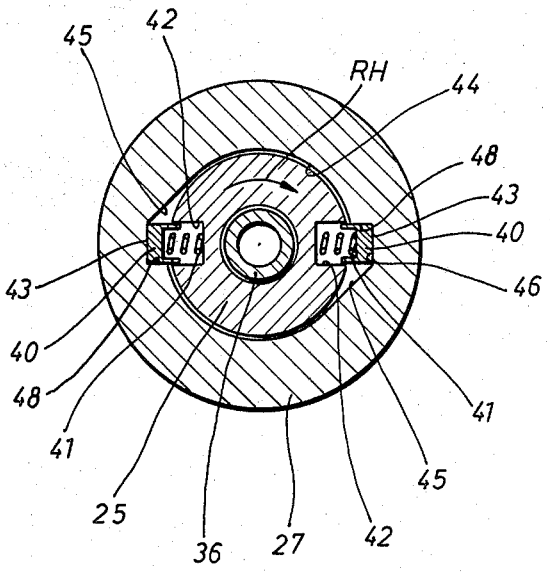
FIG. 4 is a cross-section taken on lines 4—4 of FIG. 2.

Should difficulty be encountered in deflating the packer elements 19 and 19', or should the elements become stuck in the hole for any reason, the safety joint 18 can be backed off as follows. The pipe string 10 is rotated to the left at the surface. The keys 40 will traverse the surface 44 and the ramps 45 until they engage the shoulders 48, as shown in FIG. 4, after which the housing 27 will be driven by the mandrel 25 in left-hand rotation. The safety joint 18, which has very coarse threads, is designed to be the point at which unthreading or back-off will occur responsive to left-hand torque, particularly where some of the weight of the pipe string 10 is slacked off on the joint as left-hand torque is applied. All tool components above the safety joint 18 then can be removed from the well, and the straddle packer system can be washed over and removed from the well using typical fishing procedures.

It now will be recognized that a new and improved inflatable packer testing apparatus has been disclosed including a clutch mechanism to enable back-off of a safety joint located between a rotary pump and the packers responsive to left-hand rotation. Certain changes or modifications may be made in the disclosed embodiment without departing from the inventive concepts involved. For example, only a single key could be used, and the ramps could incline inwardly and lead to the inner edge of the stop shoulder. Thus it is the aim of the appended claims to cover all such changes and modifications falling within the true spirit and scope of the present invention.

What is claimed is:

1. Apparatus adapted for use in drill stem testing a well interval that is isolated by inflatable packer means, comprising: relatively rotatable mandrel and housing assemblies, one of said assemblies being connected to said packer means and the other of said assemblies being connected to a pipe string extending upwardly to the surface; pump means responsive to rotation of said other assembly relative to said one assembly in the right-hand direction for supplying fluid under pressure to said packer means to inflate the same; a safety joint located in said apparatus between said one assembly and said packer means; and prevention means for enabling only right-hand rotation of said other assembly relative to said one assembly so that left-hand rotation of the pipe string can be employed to release said safety joint.

2. The apparatus of claim 1 wherein said preventing means comprises clutch means between said assemblies for causing said assemblies to rotate together when said other assembly is rotated in said opposite rotational direction.

3. The apparatus of claim 2 wherein said clutch means includes spring-loaded detent means on said other assembly, and annular surface means on said one assembly, said surface means having a radially directed stop shoulder against which said detent means abuts when rotation in said opposite direction is attempted.

4. Apparatus adapted for use in drill stem testing a well interval that is isolated by inflatable packer means, comprising: a mandrel mounted for rotation relative to a housing, said housing being coupled to said packer means and said mandrel being connected to a pipe string extending upwardly to the surface; pump means responsive to right-hand rotation of said mandrel relative to said housing for supplying fluid under pressure to said packer means to inflate the same; safety joint means connected between said housing and said packer means, said safety joint means being adapted to be disconnected in response to left-hand rotation; and clutch means for enabling only right-hand rotation of said mandrel relative to said housing so that left-hand rotation of the pipe string can be employed to release said safety joint means.

5. The apparatus of claim 4 wherein said clutch means includes at least one outwardly biased key mounted on said mandrel and being radially movable with respect thereto, and stop shoulder means arranged in said housing to face in said right-hand direction, said stop shoulder means being engaged by said key when said mandrel is rotated to the left.

6. The apparatus of claim 5 wherein said stop shoulder forms the side wall of a generally radially directed recess in said housing, the opposite side wall of said recess being inclined to provide a ramp surface that enables said key to enter said recess and come into engagement with said stop shoulder as said mandrel is rotated to the left and to cause said key to be cammed inwardly after being rotated past said stop shoulder as said mandrel is rotated to the right.

7. The apparatus of claim 4 wherein said clutch means includes diametrically opposed outwardly biased keys mounted on said mandrel and being inwardly and outwardly movable with respect thereto, and surface means on the interior wall of said housing including stop shoulders facing in said right-hand direction and arranged to be engaged by said keys when said mandrel is rotated to the left.

8. The apparatus of claim 7 wherein said stop shoulders form the side walls of generally radially directed recesses in said housing, the opposite side walls of said recesses being inclined to enable said keys to move outwardly into said recesses and into engagement with said stop shoulders as said mandrel is rotated to the left and to cause said keys to be cammed inwardly after being rotated past said stop shoulders as said mandrel is rotated to the right.

* * * * *